US005974631A

United States Patent [19]

Leifeld

[11] Patent Number: 5,974,631

[45] Date of Patent: Nov. 2, 1999

[54] APPARATUS FOR MAKING A FIBER BATT

[75] Inventor: Ferdinand Leifeld, Kempen, Germany

[73] Assignee: Trützschler GmbH & Co. KG, Mönchengladbach, Germany

[21] Appl. No.: 09/152,523

[22] Filed: Sep. 14, 1998

[30] Foreign Application Priority Data

Sep. 13, 1997 [DE] Germany ..... 197 40 338

[51] Int. Cl.[6] ..... D01G 25/00

[52] U.S. Cl. ..... 19/304; 19/296; 19/300; 156/322

[58] Field of Search ..... 19/144, 145, 148, 19/161.1, 296, 300, 302, 303, 304, 307, 308; 209/17, 135, 138, 139.1; 156/62.2, 322, 499; 425/80.1, 82.1, 83.1

[56] References Cited

U.S. PATENT DOCUMENTS

| | | | |
|---|---|---|---|
| 1,375,985 | 4/1921 | Vardell | 19/58 |
| 1,375,986 | 4/1921 | Vardell | 19/58 |
| 2,589,008 | 3/1952 | Lannon . | |
| 3,121,921 | 2/1964 | Latour | 19/59 |
| 3,792,943 | 2/1974 | Helgesson | 425/83.1 |
| 5,303,455 | 4/1994 | Leifeld . | |
| 5,628,090 | 5/1997 | Lock . | |

FOREIGN PATENT DOCUMENTS

| | | |
|---|---|---|
| 1 267 152 | 4/1968 | Germany . |
| 33 25 669 | 2/1984 | Germany . |
| 40 36 014 | 5/1992 | Germany . |
| 43 19 123 | 6/1996 | Germany . |
| 196 10 755 | 9/1997 | Germany . |
| 462 091 | 10/1968 | Switzerland . |

*Primary Examiner*—Michael A. Neas
*Assistant Examiner*—Gary L. Welch
*Attorney, Agent, or Firm*—Venable; Gabor J. Kelemen

[57] ABSTRACT

An apparatus for making a fiber batt includes an opening roll for opening fibers fed thereto; a fiber removing device directing an air stream to the opening roll for removing the opened fiber therefrom; a downwardly open fiber gathering hood; an arrangement for introducing into the hood an air stream carrying the opened fiber removed from the opening roll; an air-pervious, continuously moving fiber gathering surface covered by the fiber gathering hood; an arrangement for forcing air from the fiber gathering hood through the fiber gathering surface for depositing the fibers thereon to form a fiber batt; and an arrangement for heating the fibers with a heated air stream in a zone between the opening roll and the fiber gathering surface for effecting a heat treatment of the fibers, such as a binding of the fibers with a binding agent mixed to the fibers.

17 Claims, 4 Drawing Sheets

APPARATUS FOR MAKING A FIBER BATT

CROSS REFERENCE TO RELATED APPLICATION

This application claims the priority of German Application No. 197 40 338.7 filed Sept. 13, 1997, which is incorporated herein by reference.

BACKGROUND OF THE INVENTION

This invention relates to an apparatus for making a fiber batt composed, for example, of cotton, chemical fibers, fiber mixtures and the like. The apparatus includes a fiber opener having a feeding device immediately followed, for example, by a series of consecutively disposed opening rolls. With the last opening roll (such as a sawtooth roll) of the series a pneumatic fiber removing device is associated which includes a pressurized air source for generating an air stream directed generally tangentially to the opening roll. Further, downstream of the fiber opener a fiber batt forming device is disposed which includes a continuously moving fiber gathering surface. The fiber gathering surface is air pervious and is exposed to a suction stream. Above the gathering surface a downwardly open chamber (hood) is disposed.

In a known apparatus of the above-outlined type, as described, for example, in U.S. Pat. No. 5,303,455, the fiber gathering surface is an upper, working face of a circulating conveyor belt at the output of which, at the height of the end roll of the belt, two cooperating calender rolls are provided which serve for the mechanical densification of the fiber batt discharged by the conveyor belt.

SUMMARY OF THE INVENTION

It is an object of the invention to an improved apparatus of the above-outlined type in which a heat treatment (mutual binding) of the fibers is prepared and/or performed in a simple manner and the result of the heat treatment (the degree of the binding) is significantly ameliorated.

This object and others to become apparent as the specification progresses, are accomplished by the invention, according to which, briefly stated, the apparatus for making a fiber batt includes an opening roll for opening fibers fed thereto; a fiber removing device directing an air stream to the opening roll for removing the opened fiber therefrom; a downwardly open fiber gathering hood; an arrangement for introducing into the hood an air stream carrying the opened fiber removed from the opening roll; an air-pervious, continuously moving fiber gathering surface covered by the fiber gathering hood; an arrangement for forcing air from the fiber gathering hood through the fiber gathering surface for depositing the fibers thereon to form a fiber batt; and an arrangement for heating the fibers with a heated air stream in a zone between the opening roll and the fiber gathering surface for effecting a heat treatment of the fibers, such as a binding of the fibers with a binding agent mixed to the fibers.

As a result of the measures according to the invention, the removal of the fiber batt from the last sawtooth roll of the fiber opener and the binding of the fibers to one another are effected in a particularly simple manner. The combination according to the invention makes possible a binding of the fibers even before and/or during the batt forming on the fiber gathering surface. By virtue of the fact that the air stream which serves for the removal of the fibers from the last sawtooth roll may be, at the same time, used for binding the fibers together, the technological outlay is very significantly simplified.

While German Offenlegungsschrift 33 25 669 describes a fiber batt making apparatus in which fiber binding is effected by application of heat, the drying and curing of the fiber batt, however, is performed in a separate oven situated downstream of the batt forming device.

The invention has the following additional advantageous features:

- A heat activated binding agent, such as polypropylene fibers, is mixed to the textile fibers.
- The pressurized or suction air stream is heated to the temperature required for binding the fibers.
- The air stream containing the fibers and the binding agent are heated.
- The fiber carrying air stream is heated on the batt forming device, such as a screening belt, a screening drum or the like, to the temperature required for binding the fibers forming the batt.
- The batt forming device and the heating device form an integral structural unit.
- The air stream intended for the batt forming device is heated to the temperature required for the batt binding.
- The heated pressurized or suction air stream is used for removing the fibers from the last sawtooth roll of the fiber opening roll series.
- The heated air stream is withdrawn through the batt forming device.
- A device for generating hot air such as a heat exchanger is provided.
- A cold air stream is directed to the sawtooth roll.
- The cold air stream is mixed with the hot air stream.
- A closed circulating air system for the heated air is provided.
- An open air system for the heated air is provided.
- A fan is provided for driving the heated air.
- A fan is provided for driving the cold air.
- A fan is provided for withdrawing the suction air stream.
- A temperature regulating device is provided for regulating the air temperature.
- An air flow quantity regulating device is provided for regulating the air quantity.
- An air flow rate regulating device is provided for regulating the rate of the air flow.
- Upstream of the fiber opener a fiber feeding device such as an FBK model manufactured by Truitzschler GmbH & Co. KG, Mönchengladbach, Germany is provided.
- Downstream of the fiber gathering surface a batt removal device is arranged.
- The fiber removal device is arranged tangentially to the last sawtooth roll and an air stream generated by the device is directed from below in an upward direction.
- The fiber gathering surface is constituted by an upper face of a circulating, air pervious (perforated) conveyor belt and a suction device is disposed underneath the underside of its upper flight.
- The suction device is a suction box having a plurality of separate compartments each provided with a suction conduit containing a flow rate adjusting throttle.
- The fiber gathering surface is constituted by an outer face of a rotating, air pervious (perforated) drum through which a suction stream passes.
- The air pervious conveyor belt is inclined upwardly in the working direction.

A valve is provided, having a suction side coupled to the suction box of the fiber gathering surface and a pressure side coupled to the fiber removal device for the last sawtooth roll.

A device for regulating the thickness of the fiber batt is provided.

The gathering chamber extending over the fiber gathering surface has a curved upper wall face.

At the outlet end of the fiber gathering surface a sealing roll is provided between the end roll of the conveyor and the lower boundary of the gathering chamber.

At least one measuring member, for example, a flow rate measuring device, a pressure sensor, an inductive path sensor and at least one setting member, for example regulated driving devices and a control-and-regulating device are electrically connected to a central control-and-regulating device.

DESCRIPTION OF THE PREFERRED EMBODIMENTS

Figure 1:
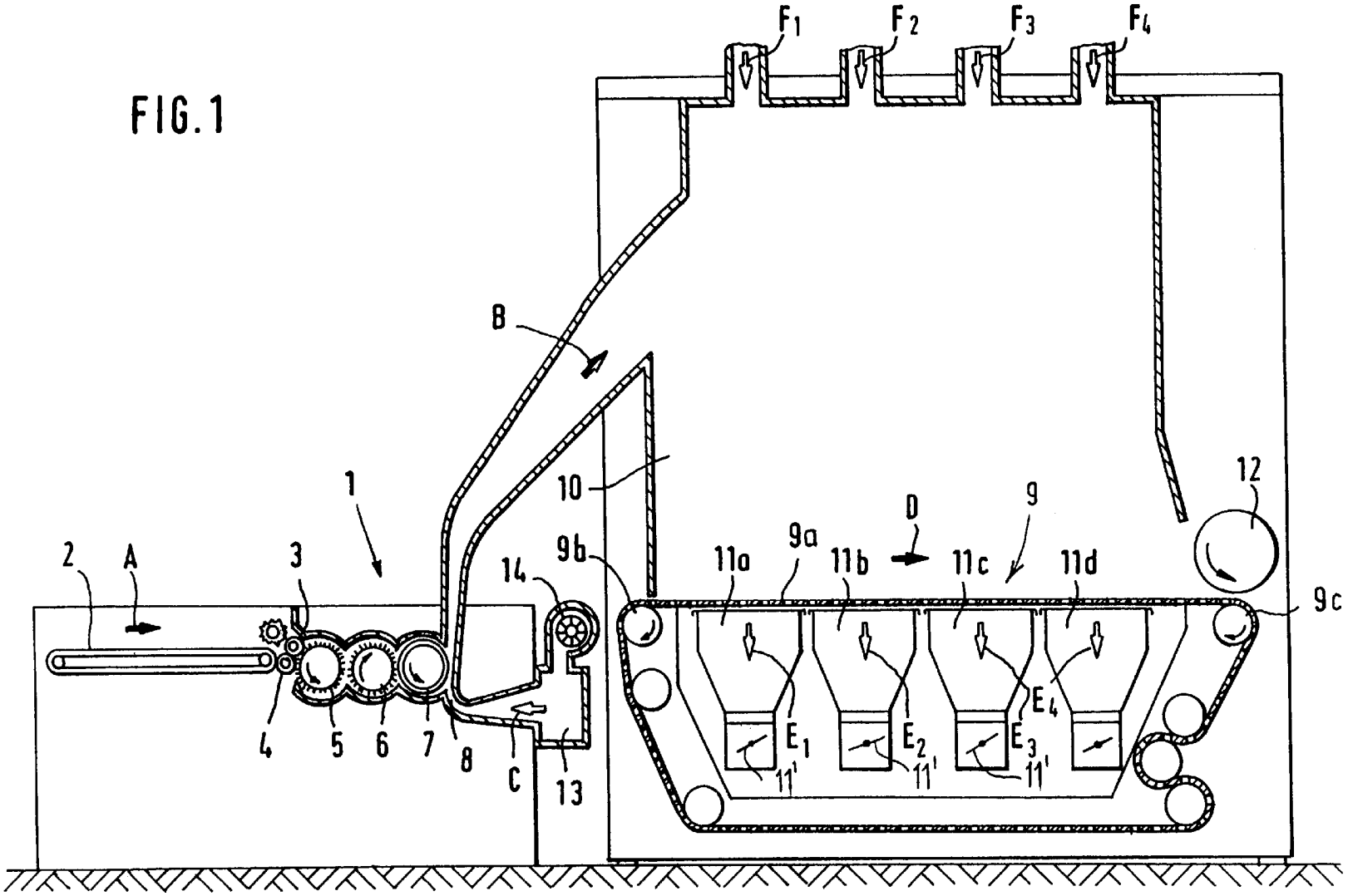
FIG. 1 is a schematic side elevational view of a preferred embodiment of the invention.

Turning to FIG. 1, the fiber material is, as an input fiber tuft batt A, introduced on a conveyor belt 2 into a fiber opening device 1 which may be a TUFTOMAT TFV 3 model manufactured by Trützschler GmbH & Co. KG.

The fiber opener 1 has two feed rolls 3 and 4 followed by serially arranged opening rolls 5, 6 and 7. The first opening roll 5 is a fully-spiked roll 5 whereas the rolls 6 and 7 are sawtooth rolls. With the last sawtooth roll 7 a pneumatic fiber removing device 8 is associated which takes off and carries away the fibers from the sawtooth roll 7. Downstream of the fiber removing device 8 (as viewed in the fiber advancing direction) a continuously moved, air pervious, fiber gathering base (fiber gathering surface) is arranged which is constituted by a perforated belt 9. Above the belt 9 a downwardly open fiber gathering hood 10 is provided. The fiber material is carried from the last sawtooth roll 7 by a pressurized air stream B into the hood 10 and is deposited therein onto the belt 9. The air outlet nozzle of the fiber removing device 8 ejecting the air stream C is disposed tangentially upwardly to the last sawtooth roll 7 and thus the pressurized air stream C is directed from below in an upward direction.

The belt 9 has an upper flight 9*a* whose upper face constitutes the fiber batt forming (fiber gathering) surface. Facing the underside of the upper flight 9*a* of the screen belt 9, suction boxes 11*a*, 11*b*, 11*c* and lid are arranged which are connected by individual suction lines with a common suction conduit. Each suction line has a regulating device, such as a butterfly valve 11' for setting the throughgoing flow quantities $E_1$, $E_2$, $E_3$ and $E_4$, respectively. Upstream of the fiber removing device 8 a heat exchanger 13 and a fan 14 are provided for heating and driving the compressed air stream C which, in conjunction with the centrifugal force generated by the rotation of the sawtooth roll 7, removes the fibers therefrom and simultaneously heats them. $F_1$–$F_4$ indicate regulated air streams introduced into the chamber 10 at the top at spaced locations.

Figure 2:
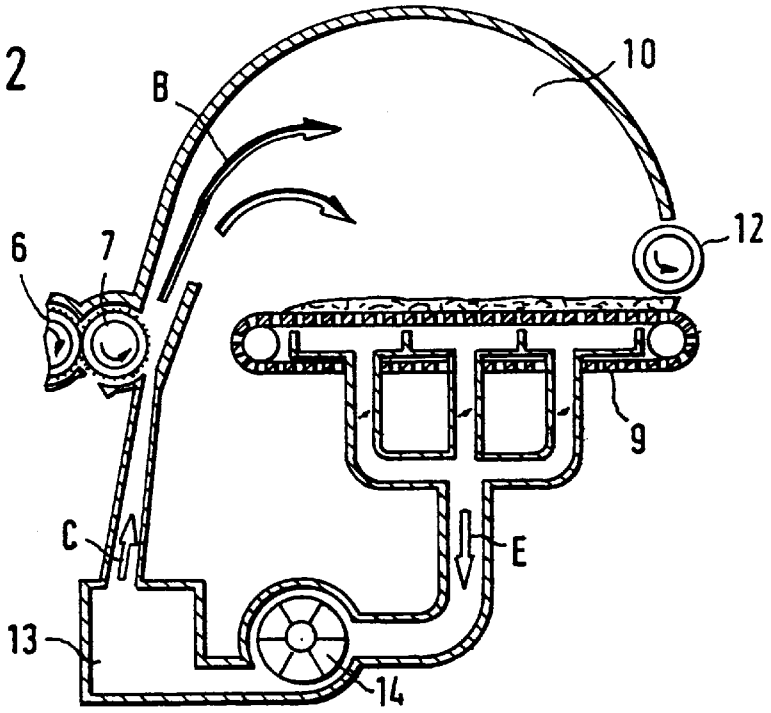
FIG. 2 is a schematic side elevational view of another preferred embodiment of the invention including a closed air circulating system.

In FIG. 2 a closed air circulating system is illustrated in which the heating air stream C exits at the pressure side of the fan 14 and after having performed its heating, fiber-carrying and fiber-depositing function, enters as an air stream E into the suction side of the fan 14.

Figure 3:
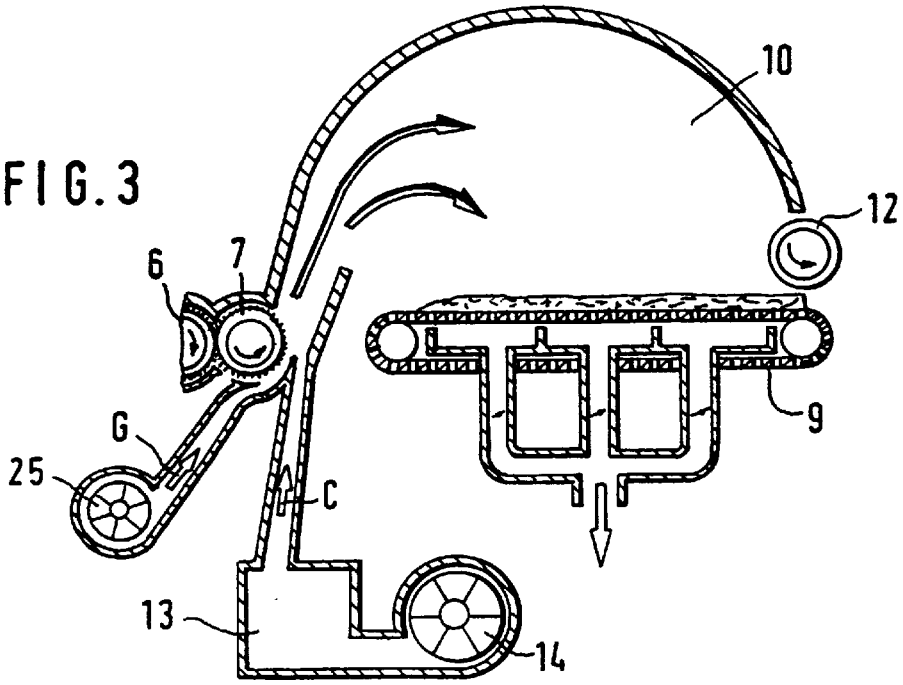
FIG. 3 is a schematic side elevational view of another preferred embodiment including means for introducing a cold and a hot air stream side-by-side into a batt forming (fiber gathering) hood.
Figure 4:
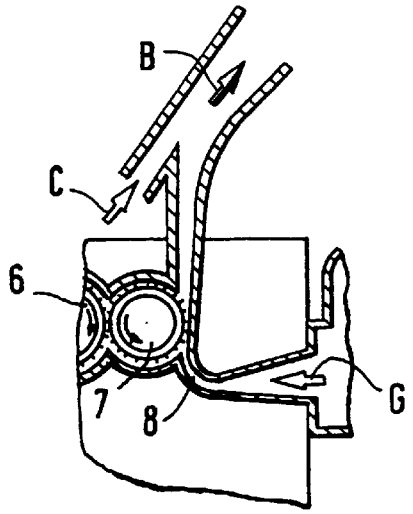
FIG. 4 is a fragmentary side elevational view of another preferred embodiment in which a hot air stream is added to a fiber carrying cold air stream prior to the introduction of the air streams into the batt forming hood.

According to FIG. 3, a cooling air stream G is provided in addition to the hot air stream C. The cooling air stream G which is driven by a fan 25, essentially takes the fibers off the last sawtooth roll 7 and cools the same. The air streams C and G are combined approximately at the height of the sawtooth roll 7 and enter the hood 10 with the fiber tufts. This embodiment may be modified according to FIG. 4 in that the cooling air stream G and the fiber-carrying heating air stream C are combined into the stream B above the sawtooth roll 7.

Figure 5:
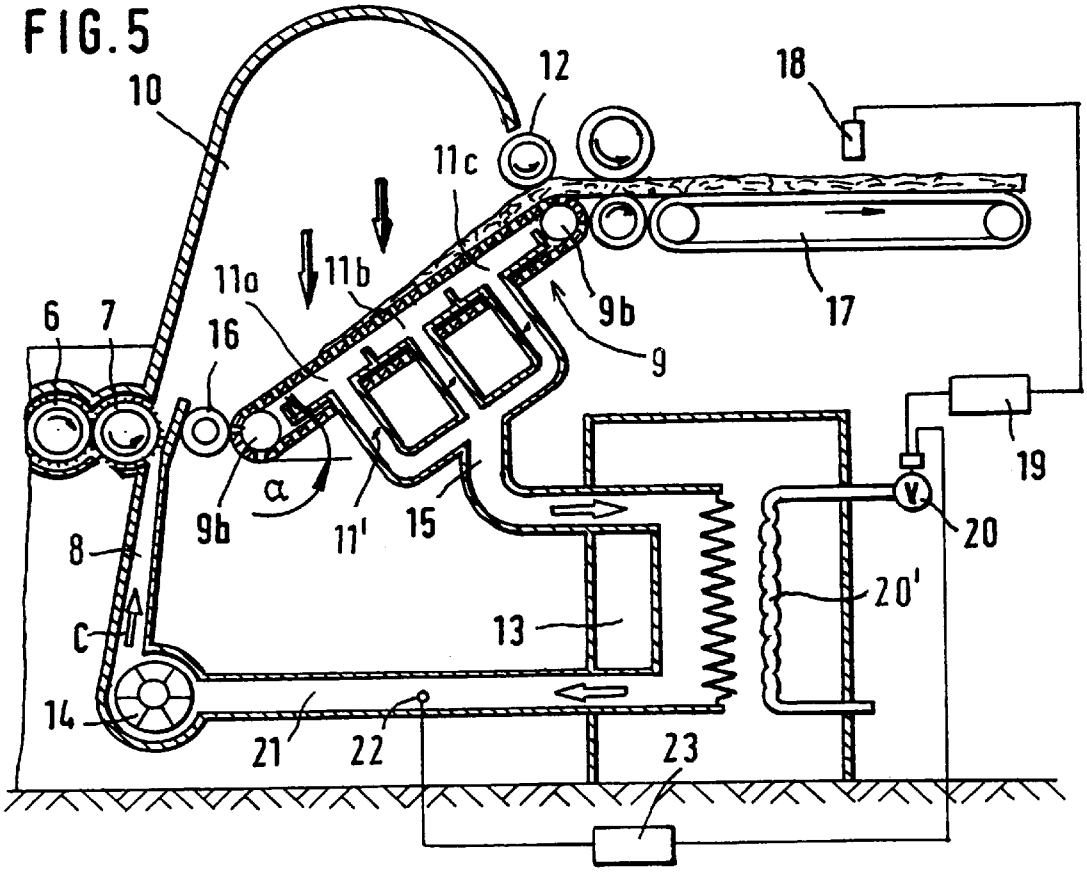
FIG. 5 is a schematic side elevational view of yet another preferred embodiment including a temperature regulating device.

Turning to the embodiment illustrated in FIG. 5, between a suction conduit 15 and the fiber removing device 8 a fan 14 is provided; its suction side is connected via the suction conduit 15 to the suction boxes 11*a*, 11*b* and 11*c* and its pressure side is connected to the fiber removing device 8 whereby a closed (that is, recirculating) air supply system is provided. In each conduit leading from the suction boxes 11*a*, 11*b* and 11*c* to the conduit 15, a respective butterfly valve 11' is disposed for controlling the flow rate. Thus, the intake side of the valves 11' is oriented towards the respective suction boxes, whereas their outlet side is oriented toward the fiber removing device 8.

The belt 9 is arranged at an angle $\alpha$ under the fiber gathering hood 10 and slopes upwardly as viewed in its direction of travel. The fiber gathering hood 10 has a curved upper wall face. At the inlet end of the belt 9 a sealing roll 16 is provided between the fiber removing device 8 and the belt supporting roll 9*b* and likewise, at the outlet end of the belt 9 a sealing roll 12 is provided between the lower boundary of the fiber gathering hood 10 and the belt supporting roll 9*b*. Between the suction conduit 15 and the fan 14 a heat exchanger 13 is provided which heats the air stream C. Downstream of the perforated belt 9 a transporting belt 17 is disposed, to which the fiber batt formed on the belt 9 is transferred.

Above the belt 17 a temperature sensor 18 is disposed which is connected via a regulator 19 to a setting member (valve) 20 which regulates the flow rate of a heating medium flowing in a conduit 20' of the heat exchanger 13. A further temperature sensor 22 which is situated in the air conduit 21 leading to the intake (suction) side of the fan 14, is also connected to the valve 20 by a regulator 23.

Figure 6:
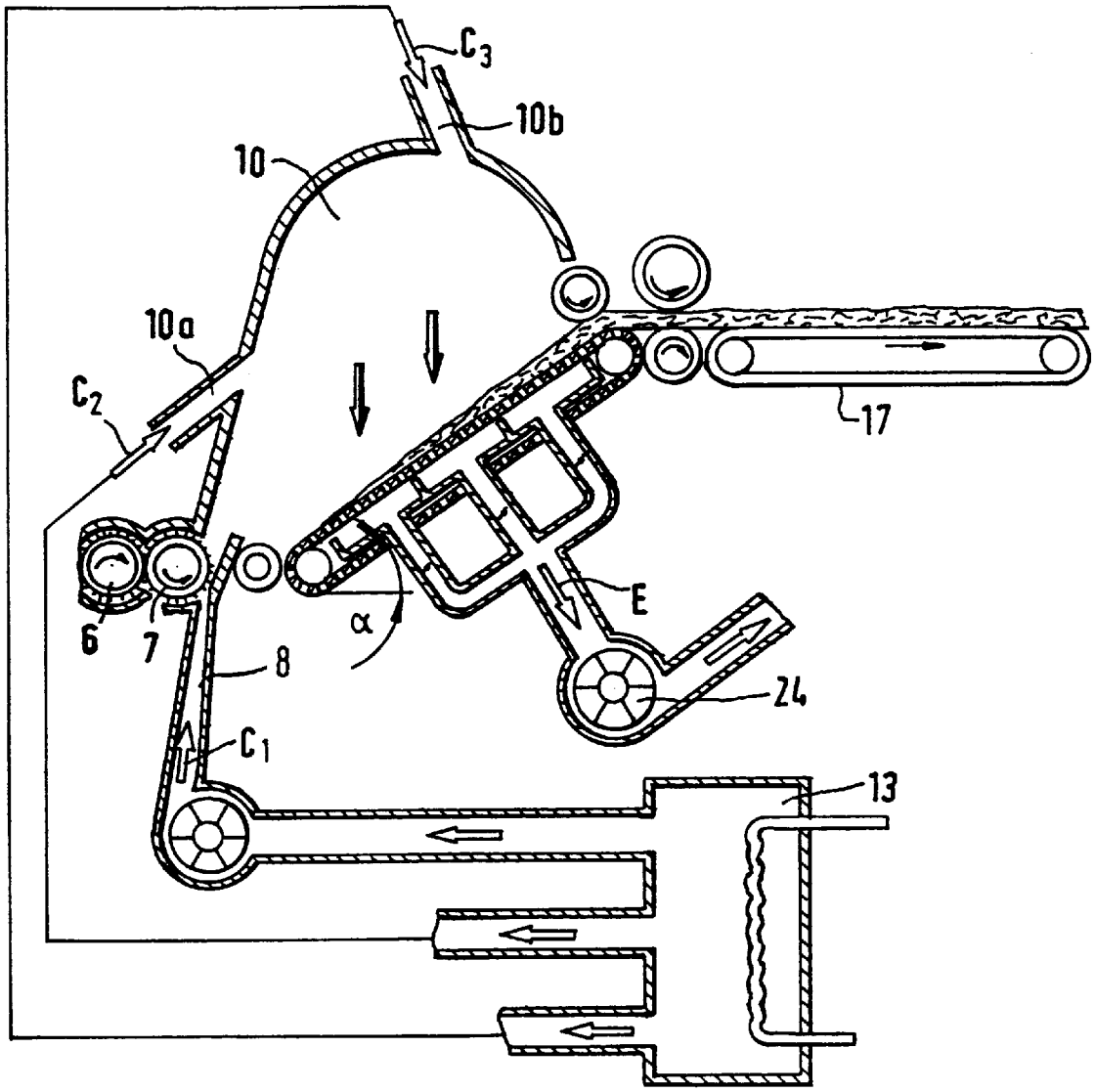
FIG. 6 is view similar to FIG. 5, having an open air-supply system and a device for generating a plurality of hot air streams.

Turning to FIG. 6, in an open (that is, not recirculating) air supply system a heat exchanger 13 is provided from which hot air streams $C_1$, $C_2$ and $C_3$ are introduced into the hood 10 from the environment. The hot air streams $C_2$ and $C_3$ are introduced into the hood 10 by nipples 10*a* and 10*b* provided in the wall of the hood 10. The hot air stream $C_1$ is guided in the fiber removing device 8, as described, for example, for the stream C in conjunction with FIG. 5. The air stream E is withdrawn from the system by a fan 24 and may be passed into the atmosphere through a non-illustrated filter.

According to the invention, the heating of the fiber material for binding with the fusible fibers is relocated into the zone of the batt former. The air stream used for the batt forming is heated to the temperature required for the binding so that the fiber tufts transported in the air stream are already heated prior to their deposition on the batt forming (fiber gathering) surface, such as the perforated belt 9 or a perforated drum and are, by the suction stream required for forming the batt on the belt 9, again heated, namely, to the binding temperature which has to be obtained to ensure that the fusible fibers will have their optimum effect. As a result, the heat-up period is very significantly reduced as compared to the conventional technology because in the known processes first only the outer fiber layer is heated and thereafter the heat slowly wanders inwardly into the fiber batt. Such a process carries the risk that the outer batt layer is overheated and the inner layers may be not be brought to a sufficiently high temperature. The conventional process, at least in case of particularly heavy fiber batts made of natural fibers and binding fibers, has to be performed with a certain excess temperature to ensure the acceptable results more securely. Currently, very heavy batts are becoming increasingly more significant for use as base materials for making shaped bodies, for example, vehicle inner trims, inner door parts and housings for various purposes. An economical manufacture of ecologically advanced products underlines the significance of such a technology. It is a significant advantage of the invention that the apparatus and system outlay are significantly reduced.

It will be understood that the above description of the present invention is susceptible to various modifications, changes and adaptations, and the same are intended to be comprehended within the meaning and range of equivalents of the appended claims.

What is claimed is:

1. An apparatus for making a fiber batt comprising (a) an opening roll for opening fibers fed thereto;

(b) a fiber removing device including means for directing an air stream to said opening roll for removing the opened fiber from said opening roll;

(c) a downwardly open fiber gathering hood;

(d) means for introducing into said hood an air stream carrying the opened fiber removed from said opening roll;

(e) an air-pervious fiber gathering surface covered by said fiber gathering hood;

(f) means for continuously moving said fiber gathering surface;

(g) means for forcing air from said fiber gathering hood through said fiber gathering surface for depositing the fibers thereon to form a fiber batt; and (h) means for heating the fibers with a heated air stream in a zone between said opening roll and said fiber gathering surface for effecting a heat treatment of the fibers.

2. The apparatus as defined in claim 1, further comprising means for controlling a flow rate of the air forced through said fiber gathering surface.

3. The apparatus as defined in claim 1, wherein the air stream directed to said opening roll is a first air stream which is a cold air stream; said means for heating comprises (a) means for generating a second air stream;

(b) a heater for heating said second air stream; and (c) means for combining said first and second air streams at a level of said opening roll.

4. The apparatus as defined in claim 1, wherein the air stream directed to said opening roll is a first or cold air stream; said means for heating comprises (a) means for generating a second air stream;

(b) a heater for heating said second air stream; and (c) means for combining said first and second air streams downstream of said opening roll as viewed in a direction of flow of said first air stream.

5. The apparatus as defined in claim 1, wherein said means for forcing air through said fiber gathering surface comprises (a) a suction box disposed underneath said fiber gathering surface and being open toward said fiber gathering surface; and (b) a fan drawing air through said suction box and said fiber gathering surface.

6. The apparatus as defined in claim 1, further comprising a rotary perforated drum having an outer face constituting said fiber gathering surface.

7. The apparatus as defined in claim 1, wherein said means for heating the fibers with a heated air stream includes means for drawing air from the environment and further comprising means for discharging into the environment the air forced through said fiber gathering surface, whereby an open air circulating system is provided.

8. The apparatus as defined in claim 1, wherein said means for heating includes a heat exchanger.

9. The apparatus as defined in claim 1, wherein said means for heating the air stream comprises (a) a heater;

(b) a setting device for regulating a heater temperature; and (c) a sensor exposed to the heated air stream for detecting a temperature thereof; said sensor being operatively connected to said setting device for controlling the heater temperature as a function of the temperature detected by said sensor.

10. The apparatus as defined in claim 1, further comprising a transporting device adjoining said fiber gathering surface for receiving the fiber batt from said fiber gathering surface; further wherein said means for heating the air stream comprises (a) a heater;

(b) a setting device for regulating a heater temperature; and (c) a sensor disposed adjacent said transporting device for detecting a temperature of the fiber batt on said transporting device; said sensor being operatively connected to said setting device for controlling the heater temperature as a function of the temperature detected by said sensor.

11. The apparatus as defined in claim 1, wherein said means for heating comprises (a) means for introducing the fiber-carrying air stream into said hood at a first location;

(b) a heater for heating an additional air stream; and (c) means for guiding the additional heated air stream from said heater and for introducing the additional heated air stream into said hood at a second location being spaced from said first location.

12. The apparatus as defined in claim 1, wherein said means for heating comprises a heater for heating the air stream directed to said opening roll by said fiber removing device.

13. The apparatus as defined in claim 12, further comprising (a) means for introducing the fiber-carrying heated air stream into said hood at a first location; and (b) means for guiding an additional heated air stream from said heater and for introducing the additional heated air stream into said hood at a second location being spaced from said first location.

14. The apparatus as defined in claim 1, further comprising a closed air circulating system comprising (a) a suction box disposed underneath said fiber gathering surface and being open toward said fiber gathering surface;

(b) a conduit extending from said suction box to said opening roll; and (c) a fan disposed in said conduit for drawing air through said fiber gathering surface and driving air to said opening roll; said fan and a length portion of said conduit forming part of said fiber removing device.

15. The apparatus as defined in claim 14, further comprising a valve having an intake side connected to said suction box and an output side connected to said fiber removing device.

16. The apparatus as defined in claim 14, wherein said means for heating comprises a heater connected to said conduit.

17. The apparatus as defined in claim 16, wherein said heater is connected to said conduit between said fan and said suction box.

* * * * *